US006519810B2

(12) United States Patent
Kim

(10) Patent No.: US 6,519,810 B2
(45) Date of Patent: Feb. 18, 2003

(54) VACUUM CLEANER NOZZLE

(75) Inventor: Se-Hyun Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/793,512

(22) Filed: Feb. 27, 2001

(65) Prior Publication Data

US 2001/0037536 A1 Nov. 8, 2001

(30) Foreign Application Priority Data

May 4, 2000 (KR) ..... 2000-24072
May 4, 2000 (KR) ..... 2000-24073

(51) Int. Cl.[7] ..... A47L 9/06
(52) U.S. Cl. ..... 15/415.1; 15/331; 15/399; 15/411; 15/414; 285/7
(58) Field of Search ..... 15/411, 415.1, 15/414, 328, 331, 399; 285/7

(56) References Cited

U.S. PATENT DOCUMENTS 1,072,607 A * 9/1913 Guthorn ..... 15/411
2,170,963 A * 8/1939 Dahl ..... 285/7
2,203,088 A * 6/1940 Hansson ..... 15/415.1
2,351,507 A * 6/1944 Hallock ..... 15/415.1
3,259,934 A * 7/1966 Leinfelt ..... 15/414
5,839,161 A * 11/1998 Liang ..... 15/415.1
5,967,563 A * 10/1999 Lavis et al. ..... 15/415.1
6,065,183 A * 5/2000 Hammeken et al. ..... 15/411
6,345,408 B1 * 2/2002 Nagai et al. ..... 15/411

* cited by examiner

*Primary Examiner*—Theresa T. Snider
(74) *Attorney, Agent, or Firm*—Birch, Stewart, Kolasch & Birch, LLP

(57) ABSTRACT

A vacuum cleaner, performing a cleaning operation using a nozzle casing coupled to a suction pipe or using the suction pipe free from the nozzle casing, is disclosed. This vacuum cleaner does not force a user to change an existing cleaning tool with another tool even when it is desired to clean a limited or narrow area that does not allow use of the nozzle casing during the cleaning operation. In this vacuum cleaner, the suction nozzle unit consists of a nozzle casing provided with a suction nozzle for sucking dust-laden air from a surface into the casing. This casing also has a mounting unit provided with a fitting bore communicating with the suction nozzle. A hollow cylindrical suction pipe is removably fitted into the fitting bore, with a dusting brush part formed along the lower edge thereof. A spring-biased locking bolt removably locks the position of the suction pipe within the mounting unit of the nozzle casing. A connection pipe is connected to the extension pipe of a cleaner body, while a connector is hinged to the domed end of the connection pipe so as to be tiltable relative to the connection pipe in a vertical direction. This connector also engages with the suction pipe while allowing the suction pipe to be horizontally rotatable in opposite directions.

9 Claims, 7 Drawing Sheets

VACUUM CLEANER NOZZLE

BACKGROUND OF THE INVENTION

1. Field of the Invention

The present invention relates to vacuum cleaners and, more particularly, to a vacuum cleaner designed to effectively clean limited or narrow areas in addition to large and open areas, and to be easily handled and steered at its cleaning tool while cleaning a desired area, thus being convenient to users.

2. Description of the Prior Art

FIG. 1 is a perspective view, showing the construction of a conventional canister vacuum cleaner. As shown in the drawing, the conventional vacuum cleaner comprises a body 10, provided with a motorized suction means, with a suction nozzle unit 20 connected to the body 10 by a connection unit and sucking dust-laden air from a surface into the body 10 using suction force generated from the suction means.

The connection unit, which connects the suction nozzle unit 20 to the body 10 and guides dust-laden air from the nozzle unit 20 to said body 10, comprises a flexible hose 11 connected to the air inlet opening of the body 10, a handle 12 mounted to the outside end of hose 11, and an extension pipe 13 connecting the handle 12 to the nozzle unit 20. The nozzle unit 20 thus communicates with the body 10 through the connection unit, and so the suction force of the body 10 acts within the nozzle unit 20, thus sucking dust-laden air from a surface into the nozzle unit 20 and forcibly guiding the sucked air from the nozzle unit 20 into the body 10.

The construction of the nozzle unit 20 in addition to the connection structure for connecting the nozzle unit 20 to the extension pipe 13 will be described in detail with reference to FIGS. 2 to 4. As shown in the drawings, the nozzle unit 20 has a suction pipe 23, which is hinged to the rear part of a nozzle casing 21 at its front end and is coupled to a connection pipe 24 at its rear end. The above suction pipe 23 is connected to the extension pipe 13 through the connection pipe 24 while communicating with the extension pipe 13.

A suction nozzle 22 is formed at the bottom surface of the nozzle casing 23 at a front portion, and sucks dust-laden air from a surface into the casing 23. The sucked air under pressure from the nozzle casing 21 passes through the suction pipe 23, the connection pipe 24 and the above-mentioned connection unit so as to be finally introduced into the body 10.

In such a nozzle unit 20, the hinged suction pipe 23 is rotatable relative to the nozzle casing 21 so as to be tilted up or down. That is, the suction pipe 23 is hinged to the rear part of the nozzle casing 21 at its hinge shaft 23*a* as shown in FIGS. 3 and 4, thus being rotatable relative to the casing 21 so as to be tilted up or down. Therefore, it is possible to freely adjust the tilted position of the nozzle casing 21 relative to the suction pipe 23 so as to allow the bottom surface of the casing 21 having the suction nozzle 22 to come into contact with a target surface, thus being convenient to a user while cleaning the surface.

As shown in FIG. 2, the connection pipe 24, connected to the rear end of the suction pipe 23, is bent at its middle portion at an obtuse angle. This connection pipe 24 is rotatable relative to the suction pipe 23. This means that the suction pipe 23 is rotatable to the left or right relative to the connection pipe 24.

Therefore, the suction nozzle unit 20 is adjustable in its position relative to the extension pipe 13 in a vertical direction and in a horizontal direction. Since the position of the nozzle unit 20 relative to the extension pipe 13 is adjustable in the vertical and horizontal directions as described above, it is possible to easily carry out desired cleaning work using the vacuum cleaner on a desired area.

However, the above-mentioned conventional vacuum cleaner is problematic as follows:

That is, the nozzle unit 20 of the cleaner regrettably has limitations in its area of application, because the unit 20 has a fixed size and sometimes cannot reach narrow areas, such as crevices and narrow corners. It is thus impossible to clean such narrow areas using the nozzle unit 20.

Therefore, when it is desired to clean such narrow areas, the nozzle unit 20 has to be removed from the connection pipe 24 prior to attaching a proper cleaning tool, such as a crevice tool, a rug brush or a dusting brush, to the connection pipe 24. The conventional vacuum cleaner is thus problematic in that it is necessary to repeatedly remove an existing cleaning tool from the connection pipe 24 prior to attaching a proper cleaning tool to the pipe 24 while cleaning a room having a variety of narrow areas. Such conventional vacuum cleaners thus force manufacturers to separately produce such cleaning tools while increasing production cost, and cause users inconvenience due to repeated removal and attachment of a variety of cleaning tools relative to the connection pipe while cleaning a room.

Another problem experienced in such conventional vacuum cleaners resides in that the nozzle unit 20 is designed to only suck dust-laden air from a surface into the body 10 so as to allow the air to be filtered by a dust bag within the body 10. That is, when it is desired to clean, for example, a rug or a carpet, the nozzle unit 20 cannot accomplish a desired cleaning effect expected from a dusting brush or a rug brush, and so the nozzle unit 20 regrettably has limitations in its cleaning function.

In addition, the nozzle unit 20 of the conventional vacuum cleaner is designed to be tiltable upward or downward by the hinged structure of the suction pipe 23, and tiltable to the left or right by the rotatable connection structure of the suction and connection pipes 23 and 24 as described above. However, such a tiltable structure of the nozzle unit 20 allowed by both the hinged structure of the suction pipe 23 and the rotatable connection structure of the two pipes 23 and 24 regrettably results in inconvenience to users while using the cleaner.

SUMMARY OF THE INVENTION

Accordingly, the present invention has been made keeping in mind the above problems occurring in the prior art, and an object of the present invention is to provide a vacuum cleaner, which is designed to effectively clean limited or narrow areas in addition to large and open surfaces, such as rugs or carpets, without forcing a user to change an existing cleaning tool with another tool, thus being convenient to users.

Another object of the present invention is to provide a vacuum cleaner, which is designed to be easily handled and steered at its cleaning tool while cleaning a desired area, thus allowing users to easily and conveniently use the cleaner.

In order to accomplish the above object, the present invention provides a vacuum cleaner, comprising a body provided with a motorized suction means, a suction nozzle unit for sucking dust-laden air using suction force generated from the suction means, and an extension pipe connecting the suction nozzle unit to the body and directing the dust-laden air under pressure from the suction nozzle unit into the body, wherein the suction nozzle unit comprises: a nozzle casing provided with a suction nozzle for sucking the dust-laden air into the casing, the casing also having a mounting unit provided with a fitting bore communicating with the suction nozzle; a hollow suction pipe removably fitted into the fitting bore, with a dusting brush part formed along a lower edge thereof; a locking means for removably locking the suction pipe to the mounting unit of the nozzle casing; and a connection means for connecting the suction pipe to the extension pipe while allowing the suction pipe to be tiltable upward and downward and horizontally rotatable relative to the extension pipe.

In the above vacuum cleaner, the locking means comprises: a locking hole formed on the sidewall of the hollow suction pipe; a locking bolt removably inserted into the locking hole of the suction pipe so as to lock the suction pipe to the mounting unit of the nozzle casing; a biasing means for normally biasing the locking bolt into the locking hole of the suction pipe; and a releasing means for selectively releasing the locking bolt from the locking hole so as to allow the suction pipe to be removable from the fitting bore of the nozzle casing.

In an embodiment, the releasing means comprises an outside handle integrated with the locking bolt and projected outside the mounting unit of the nozzle casing, with a junction of the locking bolt and the outside handle hinged to a predetermined portion within the mounting unit at a hinged joint such that the locking bolt is rotatable around the hinged joint to be removable from the locking hole when the outside handle is pressed down.

In another embodiment, the releasing means comprises: an inclined step formed on the sidewall of the locking bolt; an actuator having an inclined surface and coming into movable contact with the inclined step at its inclined surface; and an actuating means for selectively moving the actuator downward relative to the locking bolt, whereby the locking bolt is movable outward in a horizontal direction to be removable from the locking hole of the suction pipe when the actuator is pressed down.

In such a case, the actuating means comprises a press button integrated with the actuator and partially projected outside the top wall of the nozzle casing.

In the vacuum cleaner, the connection means comprises: a connection pipe connected to the extension pipe while communicating with the extension pipe; and a connector coupled to the connection pipe while communicating with the connection pipe, the connector being also coupled to the suction pipe, whereby the connector is hinged to the connection pipe at a hinged joint so as to be tiltable around the hinged joint relative to the connection pipe, and partially and interiorly engages with the suction pipe such that the suction pipe is horizontally rotatable relative to the connector in opposite directions.

In the vacuum cleaner, the connection pipe is provided with a domed end part opened at its lower end, while the connector is provided with a domed upper part partially opened at its upper portion. The domed end part of the connection pipe is movably seated within the domed upper part of the connector.

The present invention allows a user to clean a desired area using the nozzle casing coupled to the suction pipe or using the suction pipe free from the nozzle casing. Therefore, the vacuum cleaner of this invention does not force a user to change an existing cleaning tool with another tool even when it is desired to clean a limited or narrow area that does not allow use of the nozzle casing during a cleaning operation. This vacuum cleaner is thus convenient to users.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
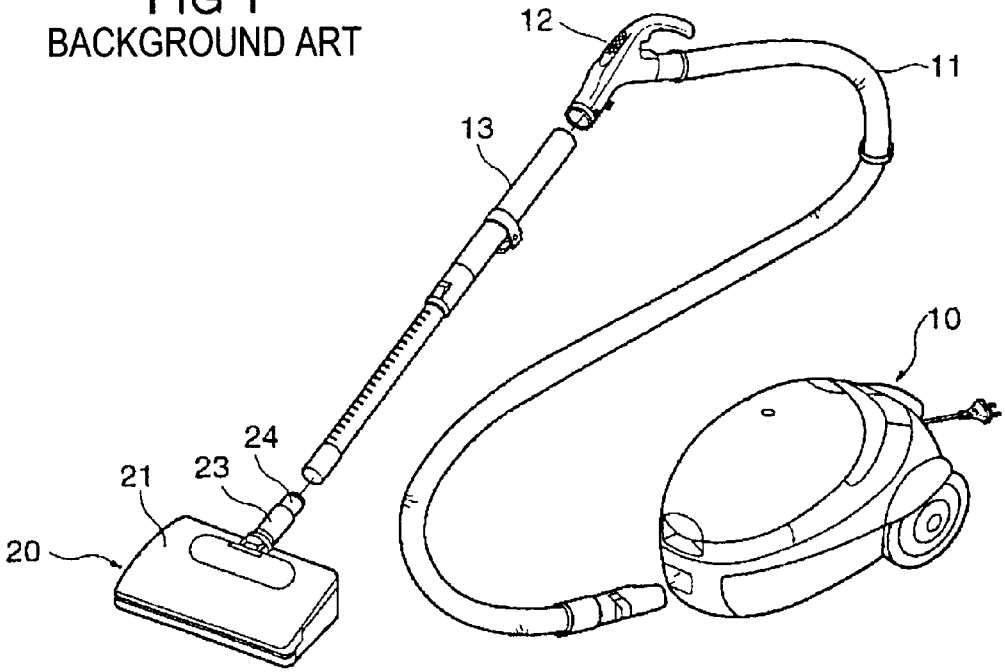
FIG 1 BACKGROUND ART
FIG. 1 is a perspective view of a conventional vacuum cleaner.
Figure 2:
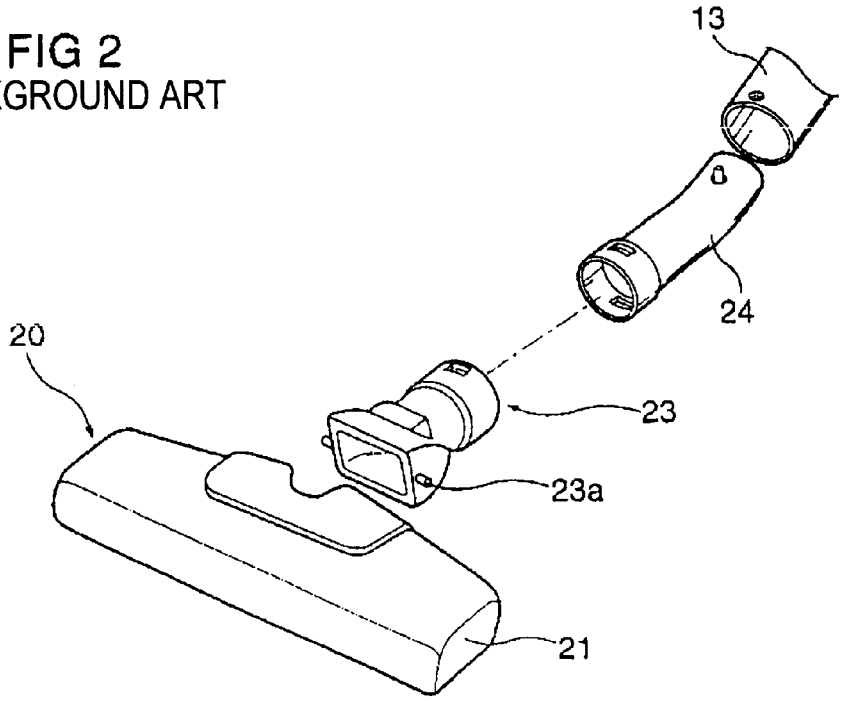
FIG 2 BACKGROUND ART
FIG. 2 is an exploded perspective view of the suction nozzle unit of the conventional vacuum cleaner of FIG. 1.
Figure 3:
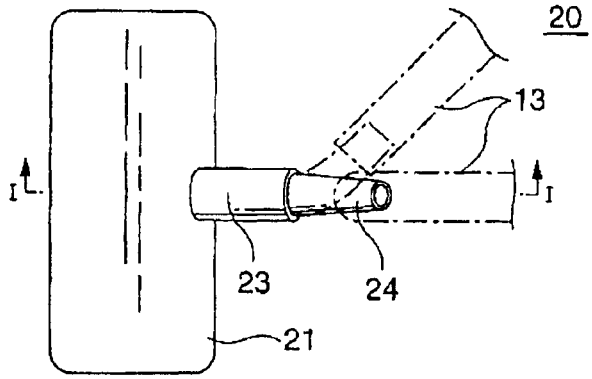
FIG 3 BACKGROUND ART
FIG. 3 is a plan view of the suction nozzle unit of FIG. 2.
Figure 4:
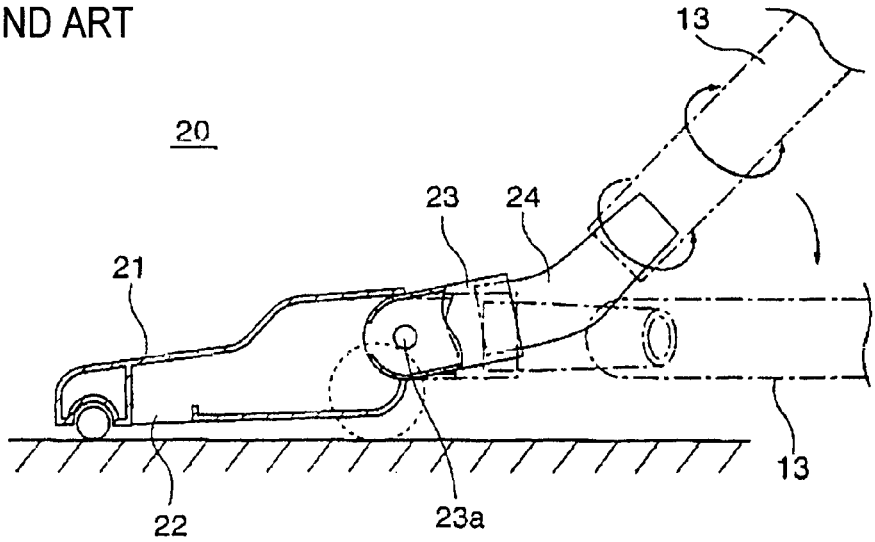
FIG 4 BACKGROUND ART
FIG. 4 is a sectional view of the suction nozzle unit of FIG. 2.
Figure 5:
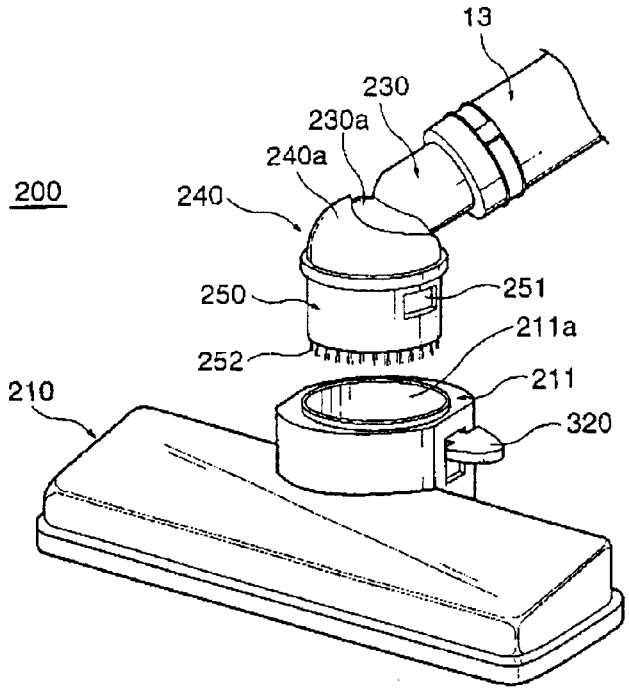
FIG. 5 is an exploded perspective view, showing the construction of the suction nozzle unit included in a vacuum cleaner in accordance with the preferred embodiment of the present invention.
Figure 6:
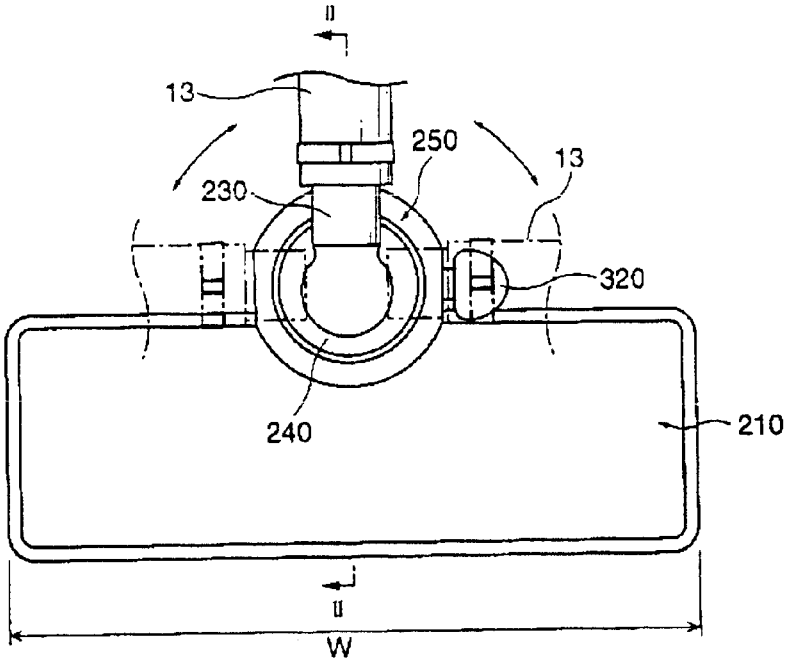
FIG. 6 is a plan view of the suction nozzle unit of FIG. 5.

FIG. 5 is an exploded perspective view, showing the construction of the suction nozzle unit 200 included in a vacuum cleaner in accordance with the preferred embodiment of the present invention. As shown in the drawing, the nozzle casing 210 of the suction nozzle unit 200 has a mounting unit 211 at its rear part, with a fitting bore 211*a* having a circular cross-section and formed in the mounting unit 211.

A cylindrical suction pipe 250 is fitted into the fitting bore 211*a* of the mounting unit 211 at its lower end, and is rotatably assembled with a domed rotary connector 240 at its upper end.

The hollow cylindrical body of the suction pipe 250 is detachably attached and locked to the fitting bore 211*a* of the mounting unit 211 at its lower end portion, and has a locking hole 251 on its sidewall.

A dusting brush part 252 is provided along the edge of the lower end of the suction pipe 250. This dusting brush part 252 is preferably used when it is desired to clean a rug or a carpet. That is, the above dusting brush part 252 accomplishes a rug or carpet cleaning effect expected from conventional dusting brushes or rug brushes.

When the suction pipe 250 is locked to the mounting unit 211 of the nozzle casing 210, dust-laden air is sucked from a surface into the body of the cleaner through the nozzle casing 210. However, when the nozzle casing 210 is removed from the suction pipe 250, dust-laden air is sucked from a surface into the body of the cleaner through the suction pipe 250. In such a case, it is possible to effectively and actively brush and clean a rug or a carpet using the dusting brush part 252 of the suction pipe 250.

In the conventional vacuum cleaner, it is necessary to remove such a nozzle casing from a connection pipe prior to attaching a separate rug brush or a separate dusting brush to the connection pipe when it is desired to clean a rug or a carpet, thus being inconvenient to a user. However, in the cleaner of this invention, the dusting brush part 252 is provided along the edge of the lower end of the suction pipe 250, and so it is possible to easily and effectively clean a rug or a carpet using the dusting brush part 252 just after simply removing the nozzle casing 211 from the suction pipe 250 when necessary. In addition, since the lateral dimension of the suction pipe 250 is much smaller than the width of the nozzle casing 211, it is possible to clean a narrow area using the pipe 250 after removing the casing 211 from the pipe 250.

Figure 7:
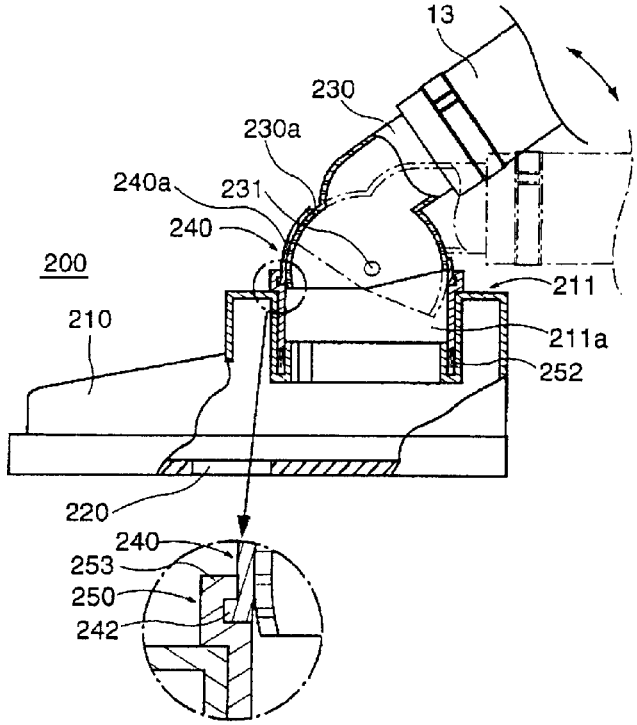
FIG. 7 is a sectional view of the suction nozzle unit of FIG. 5.

As best seen in FIG. 7, the connector 240 is rotatably mounted to the open upper end of the suction pipe 250. That is, the domed connector 240 is fitted into the open upper end of the suction pipe 250 such that the connector 240 is horizontally rotatable around the open upper end of the suction pipe 250. In the embodiment of FIG. 7, an annular flange is formed along the lower edge 242 of the connector 240, and movably and internally engages with the open upper end of the suction pipe 250. Therefore, the domed connector 240 is horizontally rotatable around the open upper end of the suction pipe 250.

The above connector 240 has a partially open domed shape at its upper portion. A connection pipe 230 is connected to the domed upper part 240*a* of the connector 240. This connection pipe 230 has an open domed part 230*a* at its lower portion. This domed lower part 230*a* of the connection pipe 230 is closely and movably seated within the domed upper part 240*a* of the connector 240 such that the connection pipe 230 is tiltable relative to the domed upper part 240*a* of the connector 240 without causing any interruption of air current within the junction of the two domed parts 230*a* and 240*a*.

As shown in FIG. 7, the domed lower part 230*a* of the connection pipe 230 is hinged to the domed upper part 240*a* of the connector 240 through a horizontal hinge shaft 231, and so the connection pipe 230 is tiltable upward or downward relative to the connector 240.

In a brief description of the above-mentioned construction of the suction nozzle unit, the connection pipe 230 is tiltable upward or downward relative to the connector 240, while the connector 240 is horizontally rotatable around the suction pipe 250. Therefore, the connection pipe 230 is tiltable upward or downward and horizontally rotatable relative to the suction pipe 250.

An air current within the suction nozzle unit 200 will be described in brief with reference to FIG. 7. The suction nozzle 220, formed at the bottom of the nozzle casing 210, communicates with the fitting bore 211*a* of the mounting unit 211, while the interior of the fitting bore 211*a* communicates with the connection pipe 230 through both the suction pipe 250 and the connector 240. Therefore, an air passage for dust-laden air extends from the suction nozzle 220 to the connection pipe 230 through the fitting bore 211*a*, the suction pipe 250, and the connector 240. This air passage is not changed and does not interrupt the air current even though the jointed parts of the suction nozzle unit 200 are tilted, rotated or moved relative to each other.

The suction pipe 250 is detachably mounted to the fitting bore 211*a* of the mounting unit 211 as will be described in detail herein below with reference to FIGS. 5 and 8.

Since the suction pipe 250 is detachably mounted to the fitting bore 211*a* of the mounting unit 211, it is possible to remove the nozzle casing 210 from the suction pipe 250 when it is desired to use the dusting brush part 252 of the suction pipe 250 free from the nozzle casing 210 for cleaning a rug or a carpet.

Figure 8A:
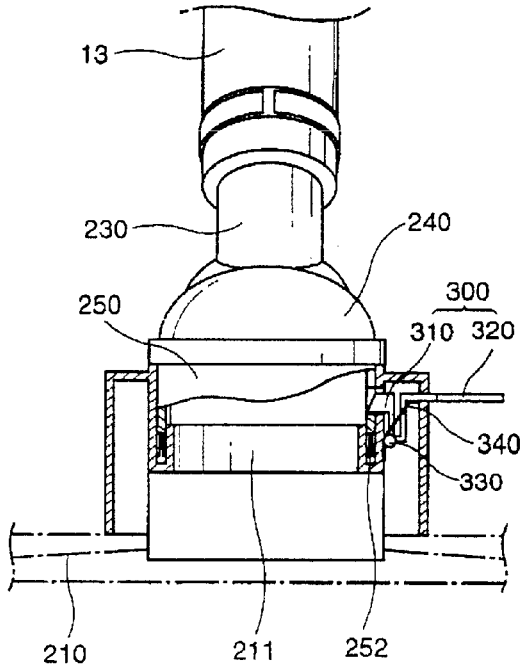
FIG. 8*a* is a sectional view, showing the position of a detachable suction pipe according to an embodiment of this invention when it is desired to assemble the suction pipe to the suction nozzle unit of FIG. 5.

In order to detachably lock the hollow cylindrical body of the suction pipe 250 to the fitting bore 211*a* of the mounting unit 211, the suction pipe 250 has a locking hole 251 on its sidewall. An elastic snap bolt 310 is provided in the mounting unit 211 as shown in FIG. 8*a*. *When the suction pipe 250 is fully inserted into the fitting bore 211a* of the mounting unit 211, the snap bolt 310 is elastically inserted into the locking hole 251 of the suction pipe 250, thus locking the position of the suction pipe 250 within the fitting bore 211*a*.

The snap bolt 310 is integrated with an outside handle 320, thus forming a locking bolt unit 300. This locking bolt unit 300 is installed in the mounting unit 211 such that the handle 320 is projected from the sidewall of the mounting unit 211 to the atmosphere, with the snap bolt 310 normally projected into the fitting bore 211*a*. The locking bolt unit 300 is hinged to a desired portion within the mounting unit 211 at a hinged joint 330 such that the unit 300 is rotatable around the hinged joint 330 in opposite directions.

The hinged joint 330 is provided at the middle portion of the snap bolt 310 and the handle 320, with a torsion spring 340 fitted over the hinged joint 330 and held against the lower surface of the handle 320 at an arm thereof. The torsion spring 340 thus normally biases the handle 320 upwardly, and allows the locking bolt unit 300 to be normally biased in a counterclockwise direction in the drawings.

Therefore, when the suction pipe 250 is fully inserted into the fitting bore 211*a* of the mounting unit 211, the snap bolt 310 is elastically inserted into the locking hole 251 of the suction pipe 250, thus locking the position of the suction pipe 250 within the fitting bore 211*a*. Since the torsion spring 340 normally biases the locking bolt unit 300 in the counterclockwise direction in the drawings, the snap bolt 310 is less likely to be undesirably removed from the locking hole 251 of the suction pipe 250.

Therefore, the suction pipe 250 is less likely to be undesirably removed from the fitting bore 211*a* of the mounting unit 211 once the snap bolt 310 is inserted into the locking hole 251 of the suction pipe 250. It is thus possible to clean a desired surface using the nozzle casing 210 of the suction nozzle unit 200.

When it is desired to clean a narrow area, which does not allow use of the nozzle casing 210 during a cleaning operation, the nozzle casing 210 is removed from the suction pipe 250 by separating the pipe 250 from the mounting unit 211 of the casing 210 while pressing the handle 320 of the locking bolt unit 300 down outside the mounting unit 211 of the nozzle casing 210.

Figure 8B:
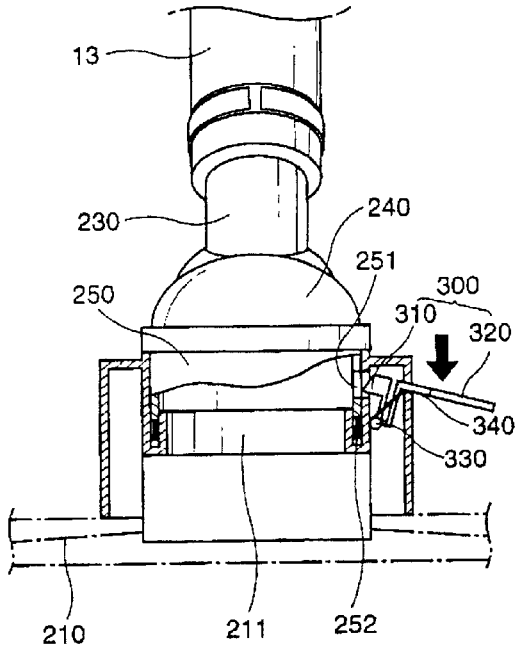
FIG. 8*b* is a sectional view, showing the position of the suction pipe of FIG. 8*a* when it is desired to remove the suction pipe from the suction nozzle unit of FIG. 5.

As shown in FIG. 8*b*, when the handle 320 is pressed down by a user with a pressing force overcoming the biasing force of the torsion spring 340, the snap bolt 310 is rotated clockwise around the hinged joint 330, thus being finally removed from the locking hole 251 of the suction pipe 250.

Figure 8C:
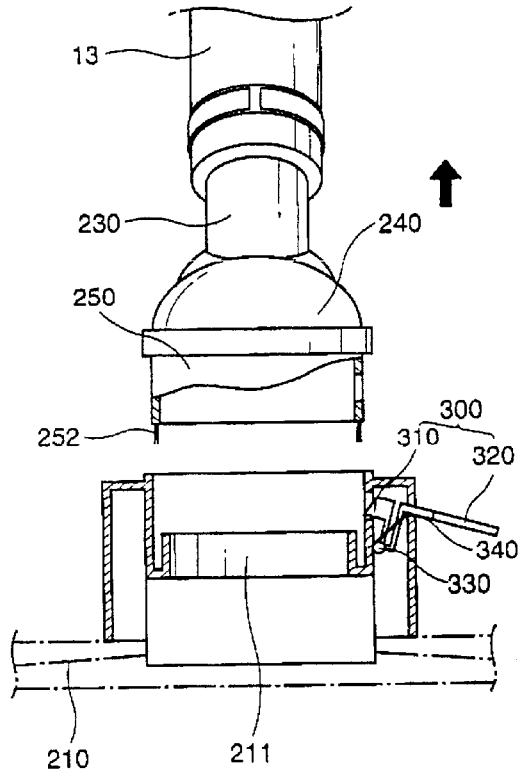
FIG. 8*c* is a sectional view, showing the position of the suction pipe of FIG. 8*a* when the suction pipe is completely removed from the suction nozzle unit of FIG. 5.

When the snap bolt 310 is removed from the locking hole 251 of the suction pipe 250, it is possible to remove the suction pipe 250 from the fitting bore 211*a* of the mounting unit 211 of the nozzle casing 210. The suction pipe 250, completely removed from the nozzle casing 210, is shown in FIG. 8*c*.

When the suction pipe 250 is completely removed from the nozzle casing 210 as described above, it is possible to effectively clean a narrow area using the suction pipe 250. In such a case, the suction pipe 250 has the dusting bush part 252 at its lower end, thus more effectively cleaning the desired narrow area.

Figure 9A:
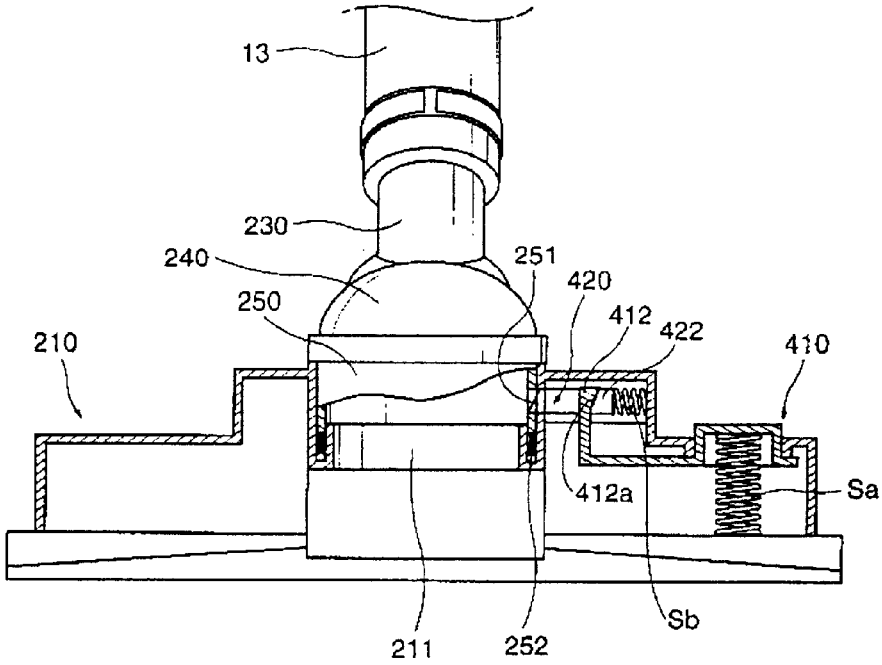
FIG. 9*a* is a sectional view, showing the position of a detachable suction pipe in accordance with another embodiment of this invention when it is desired to assemble the suction pipe to the suction nozzle unit of FIG. 5.
Figure 9B:
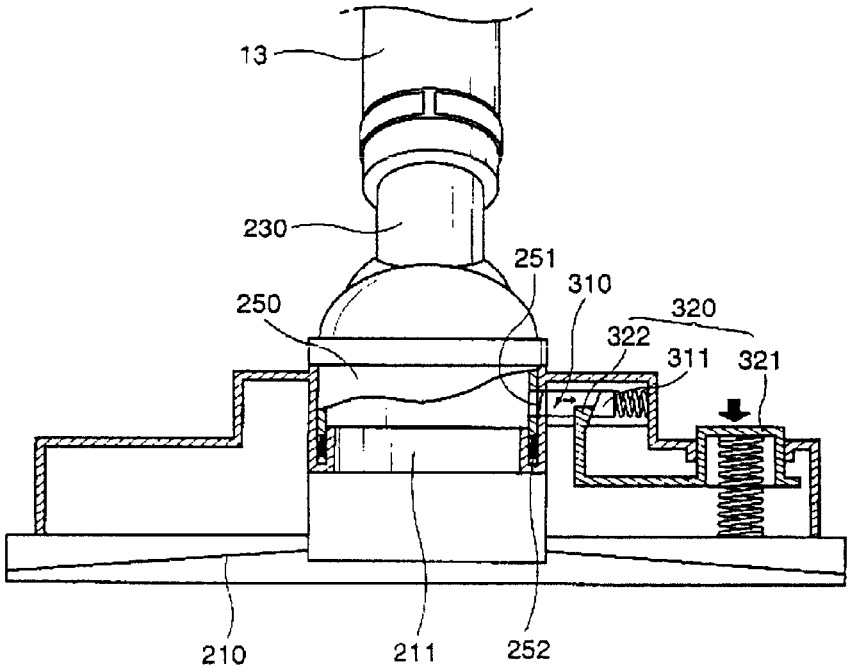
FIG. 9*b* is a sectional view, showing the position of the suction pipe of FIG. 9*a* when it is desired to remove the suction pipe from the suction nozzle unit of FIG. 5.
Figure 9C:
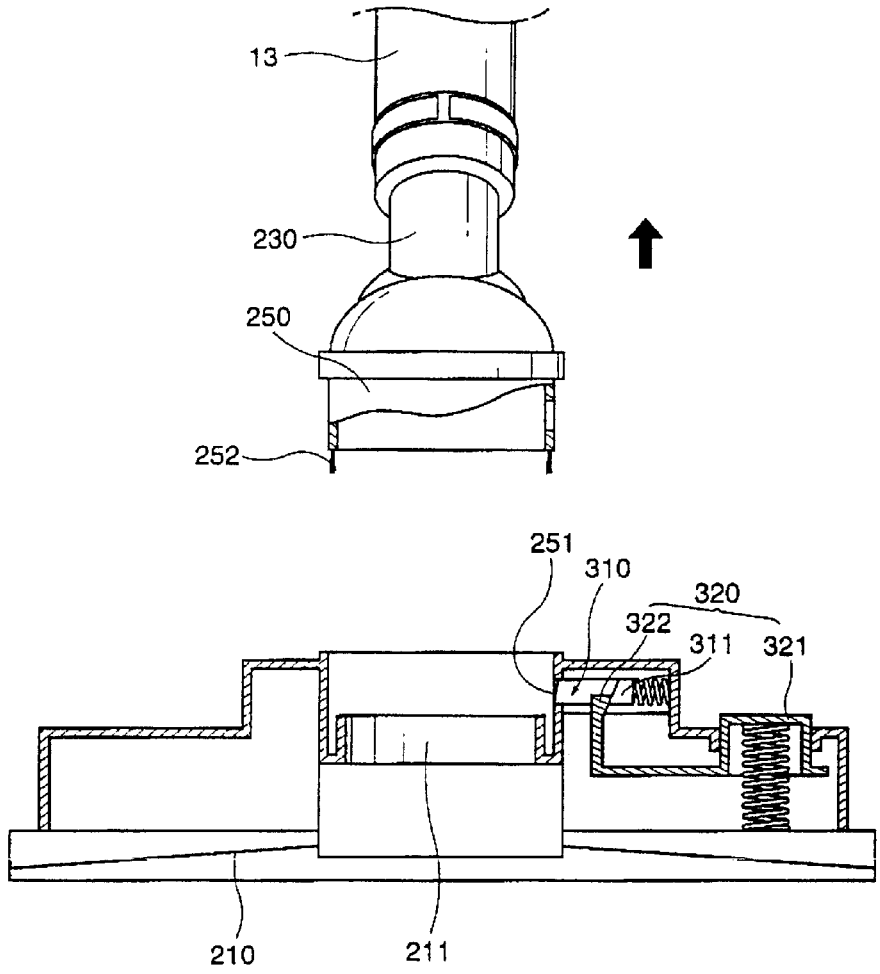
FIG. 9*c* is a sectional view, showing the position of the suction pipe of FIG. 9*a* when the suction pipe is completely removed from the suction nozzle unit of FIG. 5.

FIGS. 9*a* to 9*c* show the structure for detachably connecting the suction pipe 250 to the mounting unit 211 of the nozzle casing 210 in accordance with another embodiment of this invention. In this embodiment, the construction of the suction pipe 250 remains the same as that described above and further explanation is thus not deemed necessary.

In the embodiment of FIGS. 9*a* to 9*c*, a locking bolt 420 provided in the mounting unit 211 of the nozzle casing 210 is inserted into the locking hole 251 of the suction pipe 250 when the suction pipe 250 is inserted into the mounting unit 211 as shown in FIG. 9*a*. Different from the snap bolt 310 of the embodiment of FIGS. 8*a* to 8*c*, the locking bolt 420 of this embodiment is horizontally reciprocable in opposite directions, but is normally biased to the left in the drawings by a compression coil spring Sb. Therefore, the locking bolt 420 within the locking hole 251 is less likely to be undesirably removed from the hole 251 once the bolt 420 is inserted into the hole 251.

An inclined step 422 is formed on the sidewall of the locking bolt 420, while an actuator 412, having an inclined surface 412*a* at its tip, is installed in the nozzle casing 210 such that the inclined surface 412*a* of the actuator 412 comes into movable contact with the inclined surface of the step 422.

When the inclined surface 412*a* of the actuator 412 is moved downward, the inclined step 422 of the locking bolt 420 is biased to the right in the drawings by the downward moving force of the actuator 412. Therefore, the tip of the locking bolt 420 is removed from the locking hole 251 of the suction pipe 250 as shown in FIG. 9*b*.

When the tip of the locking bolt 420 is completely removed from the locking hole 251 of the suction pipe 250 as described above, it is possible to remove the suction pipe 250 from the mounting unit 211 of the nozzle casing 210 as shown in FIG. 9*c*.

In a brief description, the downward movement of the actuator 412 results in a retraction of the locking bolt 420 from the locking hole 251 of the suction pipe 250. In order to accomplish such a movement of the actuator 412, a press button 410 is integrated with the actuator 412 and is positioned outside the nozzle casing 210 so as to allow a user to actuate the button 410. When a user presses the press button 410 down, the actuator 412 is moved downward on the inclined step 422 of the locking bolt 420.

The above press button 410 is partially exposed outside the top surface of the nozzle casing 210, and is normally biased upward by a compression coil spring Sa. Since the press button 410 is normally biased upward by the compression coil spring Sa as described above, the actuator 420 integrated with the button 410 is normally biased upward.

When it is desired to assemble or disassemble the suction pipe 250 with or from the mounting unit 211 of the nozzle casing 210, a user presses the button 410 down. The inclined surface of the actuator 412 is thus moved downward on the inclined step 422 of the locking bolt 420, and so the locking bolt 420 is moved to the right as shown in the drawings. Therefore, the tip of the locking bolt 420 is removed from the locking hole 251 of the suction pipe 250, thus allowing the suction pipe 250 to be removable from the mounting unit 211 of the nozzle casing 210 as shown in FIG. 9*c*. The suction pipe 250 free from the nozzle casing 210 is preferably usable for cleaning a narrow area, which does not allow use of the nozzle casing 210.

In this embodiment, the position of the suction pipe 250 within the fitting bore 211*a* of the mounting unit 211 of the nozzle casing 210 is maintained by the spring-biased locking bolt 420 inserted into the locking hole 251 of the suction pipe 250. In addition, when a user moves the locking bolt 420 to the right in the drawings, the bolt 420 is removed from the locking hole 251 of the suction pipe 250 and allows the suction pipe 250 to be removed from the fitting bore 211*a* of the nozzle casing 210. In the preferred embodiment of FIGS. 9*a* to 9*c*, the means for actuating the spring-biased locking bolt 420 so as to move the bolt 420 to the left or right in the drawings comprises the inclined step 422, the actuator 412 having an inclined surface 412*a*, and the spring-biased button 410. However, it should be understood that the means for actuating the locking bolt 420 may be altered from the above-mentioned construction without affecting the functioning of this invention.

As described above, the present invention provides a vacuum cleaner, which has a suction pipe designed to be removable from a nozzle casing, thereby effectively cleaning limited or narrow areas in addition to large and open surfaces without forcing a user to change an existing cleaning tool with another tool. This vacuum cleaner is thus convenient to users.

That is, it is possible for the vacuum cleaner of this invention to effectively clean a limited or narrow area, which does not allow use of the nozzle casing during a cleaning operation, by simply removing the nozzle casing from the suction pipe provided with a dusting brush part at its lower end. Therefore, different from conventional vacuum cleaners, the vacuum cleaner of this invention does not force a user to change an existing cleaning tool with another tool even when it is desired to clean a limited or narrow area that does not allow use of the nozzle casing during a cleaning operation. This vacuum cleaner is thus convenient to users.

In the suction nozzle unit included in the vacuum cleaner of this invention, the suction pipe is connected to the connection pipe through a connector such that the suction pipe is tiltable upward and downward and horizontally rotatable around the connection pipe. Therefore, the vacuum cleaner of this invention is easily handled and steered at its suction nozzle unit while cleaning a desired area. In addition, the air passage for dust-laden air, extending from the suction nozzle of the nozzle casing to the connection pipe through the fitting bore, the suction pipe and the connector, is not changed or interrupted even though the jointed parts of the suction nozzle unit are tilted, rotated or moved relative to each other. This finally allows the vacuum cleaner of this invention to always perform with a desired high cleaning effect while cleaning an area.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A vacuum cleaner, comprising a body provided with motorized suction means, a suction nozzle unit for sucking dust-laden air using suction force generated from said suction means, and an extension pipe connecting said suction nozzle unit to said body and directing the dust-laden air under pressure from the suction nozzle unit into the body, wherein said suction nozzle unit comprises:

a nozzle casing provided with a suction nozzle for sucking the dust-laden air into the casing, said nozzle casing also having a mounting unit provided with a fitting bore communicating with said suction nozzle;

a hollow suction pipe having a first end portion removably fitted into said fitting bore, said first end portion including a dusting brush part formed along a lower edge thereof, the dusting brush being removably received within said fitting bore of said mounting unit of said nozzle casing, said suction pipe further having a second end portion;

locking means for removably locking said suction pipe to the mounting unit of the nozzle casing; and connection means for connecting said second end portion of said suction pipe to said extension pipe while allowing the extension pipe to be tiltable upward and downward and horizontally rotatable relative to the suction pipe.

2. A vacuum cleaner, comprising a body provided with motorized suction means, a suction nozzle unit for sucking dust-laden air using suction force generated from said suction means, and an extension pipe connecting said suction nozzle unit to said body and directing the dust-laden air under pressure from the suction nozzle unit into the body, wherein said suction nozzle unit comprises:

a nozzle casing provided with a suction nozzle for sucking the dust-laden air into the casing, said casing also having a mounting unit provided with a fitting bore communicating with said suction nozzle;

a hollow suction pipe having a first end portion removably fitted into said fitting bore, said first end portion including a dusting brush part formed along a lower edge thereof, said suction pipe further having a second end portion;

connection means for connecting said second end portion of said suction pipe to said extension pipe while allowing the extension pipe to be tiltable upward and downward and horizontally rotatable relative to the suction pipe; and locking means for removably locking said suction pipe to the mounting unit of the nozzle casing, wherein said locking means comprises:

a locking hole formed on a sidewall of said hollow suction pipe;

a locking bolt removably inserted into the locking hole of the suction pipe so as to lock the suction pipe to the mounting unit of the nozzle casing;

biasing means for normally biasing said locking bolt into the locking hole of the suction pipe; and releasing means for selectively releasing the locking bolt from said locking hole so as to allow the suction pipe to be removable from the fitting bore of the nozzle casing.

3. The vacuum cleaner according to claim 2, wherein said releasing means comprises an outside handle integrated with said locking bolt and projected outside the mounting unit of the nozzle casing, with a junction of the locking bolt and the outside handle hinged to a predetermined portion within said mounting unit at a hinged joint such that the locking bolt is rotatable around the hinged joint to be removable from the locking hole when the outside handle is pressed down.

4. The vacuum cleaner according to claim 3, wherein said biasing means comprises a torsion spring fitted over the hinged joint and held against a surface of said outside handle at an arm thereof so as to normally bias the handle upwardly.

5. The vacuum cleaner according to claim 2, wherein said releasing means comprises:

an inclined step formed on a sidewall of said locking bolt;

an actuator having an inclined surface movable into contact with said inclined step; and actuating means for selectively moving said actuator downward relative to the locking bolt, whereby the locking bolt is movable outward in a horizontal direction to be removable from the locking hole of the suction pipe when the actuator is pressed down.

6. The vacuum cleaner according to claim 5, wherein said actuating means comprises a press button integrated with said actuator and partially projected outside a top wall of said nozzle casing.

7. The vacuum cleaner according to claim 5, wherein said biasing means comprises a spring normally biasing said locking bolt into the locking hole of the suction pipe.

8. A vacuum cleaner, comprising a body provided with motorized suction means, a suction nozzle unit for sucking dust-laden air using suction force generated from said suction means, and an extension pipe connecting said suction nozzle unit to said body and directing the dust-laden air under pressure from the suction nozzle unit into the body, wherein said suction nozzle unit comprises:

a nozzle casing provided with a suction nozzle for sucking the dust-laden air into the casing, said casing also having a mounting unit provided with a fitting bore communicating with said suction nozzle;

a hollow suction pipe having a first end portion removably fitted into said fitting bore, said first end portion including a dusting brush part formed along a lower edge thereof, said suction pipe further having a second end portion;

locking means for removably locking said suction pipe to the mounting unit of the nozzle casing; and connection means for connecting said second end portion of said suction pipe to said extension pipe while allowing the extension pipe to be tiltable upward and downward and horizontally rotatable relative to the suction pipe, wherein said connection means comprises:

a connection pipe connected to said extension pipe while communicating with the extension pipe; and a connector coupled to said connection pipe while communicating with the connection pipe, said connector being also coupled to said suction pipe, whereby said connector is hinged to said connection pipe at a hinged joint so as to be tiltable around the hinged joint relative to the connection pipe, and partially and interiorly engages with said suction pipe such that the suction pipe is horizontally rotatable relative to the connector.

9. The vacuum cleaner according to claim 8, wherein said connection pipe is provided with a domed end part opened at its lower end, while said connector is provided with a domed upper part partially opened at its upper portion, with the domed end part of the connection pipe being movably seated within the domed upper part of the connector.

* * * * *